US010149374B1

(12) United States Patent
Ridinger et al.

(10) Patent No.: US 10,149,374 B1
(45) Date of Patent: Dec. 4, 2018

(54) RECEPTACLE FOR CAPTURING MATERIAL THAT TRAVELS ON A MATERIAL PATH

(71) Applicant: ASML Netherlands B.V., Veldhoven (NL)

(72) Inventors: Armin Bernhard Ridinger, San Diego, CA (US); Kyle John Scaffidi, San Diego, CA (US); Michael Arthur Perry, Jr., Rancho Bernardo, CA (US)

(73) Assignee: ASML Netherlands B.V., Veldhoven (NL)

( * ) Notice: Subject to any disclaimer, the term of this patent is extended or adjusted under 35 U.S.C. 154(b) by 0 days.

(21) Appl. No.: 15/687,367

(22) Filed: Aug. 25, 2017

(51) Int. Cl.
*H05G 2/00* (2006.01)

(52) U.S. Cl.
CPC ..... *H05G 2/006* (2013.01); *H05G 2/008* (2013.01)

(58) Field of Classification Search
None
See application file for complete search history.

(56) References Cited

U.S. PATENT DOCUMENTS

2007/0001126 A1* 1/2007 Gayazov ..... G03F 7/70916 250/492.2
2010/0258748 A1* 10/2010 Vaschenko ..... H05G 2/003 250/504 R
2011/0164236 A1* 7/2011 Yakunin ..... G03F 7/70033 355/67
2011/0240890 A1* 10/2011 Govindaraju ..... H05G 2/001 250/504 R
2015/0338753 A1* 11/2015 Riepen ..... G03F 7/70033 250/504 R

OTHER PUBLICATIONS

"Chamfer," Wikipedia, the free encyclopedia, https://en.wikipedia.org/wiki/Chamfer, last edited on Jun. 1, 2017, downloaded on Jul. 27, 2017, 3 pages.
Rochester, "The Impact of a Liquid Drop with a Solid Surface and the Effects of the Properties of the Liquid on the Erosion of Solids," Clare Hall, University of Cambridge, Sep. 1977, 230 pages.
(Continued)

*Primary Examiner* — Andrew Smyth
(74) *Attorney, Agent, or Firm* — DiBerardino McGovern IP Group LLC

(57) ABSTRACT

A target material receptacle includes a structure including a passageway that extends in a first direction, the passageway configured to receive target material that travels along a target material path; and a deflector system configured to receive target material from the passageway. The deflector system includes a plurality of deflector elements. Each deflector element is oriented at a first acute angle relative to a direction of travel of an instance of the target material that travels along the target material path, and each deflector element in the deflector system is separated from a nearest deflector element by a distance along a second direction that is different from the first direction.

30 Claims, 7 Drawing Sheets

(56) References Cited

OTHER PUBLICATIONS

Liu et al, "Splashing Phenomena During Liquid Droplet Impact," Department of Mechanical Engineering, University of California-Riverside, California, Department of Mechanical Engineering, Korea University, Seoul, Korea, Sandia National Laboratories, Albuquerque, New Mexico, original manuscript submitted Oct. 16, 2009, final draft received Feb. 23, 2010, Atomization and Sprays 20(4), 2010, pp. 297-310.

Mundo et al., "Droplet-Wall Collisions: Experimental Studies of the Deformation and Breakup Process," Lehrstuhl für Strömungsmechanik, Universität, Erlangen, Germany, received Apr. 3, 1994, revised form received Oct. 1, 1994, Pergamon, 0301-9322(94)00069-7, Int. J. Multiphase Flow vol. 21, No. 2, 1995, pp. 151-173.

"Surface roughness," Wikipedia, the free encyclopedia, https://en.wikipedia.org/wiki/Surface_roughness, last edited on Jul. 1, 2017, downloaded on Aug. 15, 2017, 7 pages.

* cited by examiner

RECEPTACLE FOR CAPTURING MATERIAL THAT TRAVELS ON A MATERIAL PATH

TECHNICAL FIELD

This disclosure relates to a receptacle for capturing material that travels on a material path. The receptacle may be used in any system in which droplets or liquid jets are desired to be captured. For example, the receptacle may be used in an extreme ultraviolet (EUV) light source.

BACKGROUND

A liquid or partially liquid material that moves in a system may collide with a surface (an impact surface) in the system. The collision with the impact surface may result in splashing and/or scattering of the material, and the splashing and/or scattering may result in contamination of objects near the impact surface. The contamination may be, for example, bits of material that are flung from the material as a result of the collision. The contamination of the object may result in the performance of the object and/or the entire system being degraded. For example, the system may include a mirror, and contamination of the mirror may change the reflective properties of the mirror. The mirror may be a mirror in an EUV light source, and the contamination may result in reduced amounts of EUV light being output by the source.

Extreme ultraviolet ("EUV") light, for example, electromagnetic radiation having wavelengths of 100 nanometers (nm) or less (also sometimes referred to as soft x-rays), and including light at a wavelength of, for example, 20 nm or less, between 5 and 20 nm, or between 13 and 14 nm, may be used in photolithography processes to produce extremely small features in substrates, for example, silicon wafers, by initiating polymerization in a resist layer.

Methods to produce EUV light include, but are not necessarily limited to, converting a material that includes an element, for example, xenon, lithium, or tin, with an emission line in the EUV range in a plasma state. In one such method, often termed laser produced plasma ("LPP"), the required plasma may be produced by irradiating a target material, for example, in the form of a droplet, plate, tape, stream, or cluster of material, with an amplified light beam that may be referred to as a drive laser. For this process, the plasma is typically produced in a sealed vessel, for example, a vacuum chamber, and monitored using various types of metrology equipment.

SUMMARY

In one general aspect, a target material receptacle includes a structure including a passageway that extends in a first direction, the passageway configured to receive target material that travels along a target material path; and a deflector system configured to receive target material from the passageway. The deflector system includes a plurality of deflector elements. Each deflector element is oriented at a first acute angle relative to a direction of travel of an instance of the target material that travels along the target material path, and each deflector element in the deflector system is separated from a nearest deflector element by a distance along a second direction that is different from the first direction.

Implementations may include one or more of the following features. The structure also may include a base portion including an interior that is coupled to the passageway. In some implementations, at least a portion of the deflector system is positioned in the interior of the base portion, a side of the base portion is angled at a base angle relative to the first direction, and the side of the base portion extends in the second direction.

Each deflector element may include a first portion oriented at the first acute angle relative to the target material path, and an end portion that extends from the first portion, the end portion including a tip that extends substantially parallel to the target material path. The end portion of each deflector element also may include a body including a surface, and the surface of the body may form a second acute angle with the target material path. The second acute angle may be equal to or less than the first acute angle. The first portion of each deflector element may include a plate that extends in a first plane, the plate having a first extent in the first plane and a second extent in a second plane, the second plane being orthogonal to the first plane and the second extent being less than the first extent. The instance of target material may be substantially spherical and has a diameter, each tip may have a surface configured to interact with the instance of target material, and the surface of the tip may have an extent in at least one direction that is less than the diameter of the instance of target material.

In some implementations, each deflector element includes at least one surface feature configured to reduce adhesion of target material to a surface of the deflector element. The surface feature may include ripples, a region having a specific roughness, a pattern of grooves, an oxidized region, and/or a coating of a material that is different from material used in other portions of the surface of the deflector element.

The distance along the second direction between any two adjacent deflector elements may be the same. The first acute angle may be the same for all of the deflector elements. Each deflector element may be a plate, and the deflector elements may be separated along the second direction such that any one of the plates is parallel with all of the other plates.

The target material receptacle may be configured for use in an extreme ultraviolet (EUV) light source, and the target material may include a material that emits EUV light when in a plasma state.

In another general aspect, an extreme ultraviolet (EUV) light source includes an optical source configured to produce an optical beam; a vessel configured to receive the optical beam at a plasma formation location; a supply system configured to produce targets that travel along a target path toward the plasma formation location; and a target material receptacle including: a structure including a passageway that extends in a first direction, the passageway positioned to receive targets that travel on the target path and pass through the plasma formation location; and a deflector system configured to receive targets from the passageway, the deflector system including a plurality of deflector elements. Each deflector element is oriented at a first acute angle relative to a direction of travel of an instance of the material that travels along the target material path, and each deflector element in the deflector system is separated from a nearest deflector element by a distance along a second direction that is different from the first direction.

Implementations may include one or more of the following features. The structure also may include a base portion including an interior that is coupled to the passageway. In some implementations, at least a portion of the deflector system is positioned in the interior of the base portion, a side of the base portion is angled at a base angle relative to the first direction, and the side of the base portion extends in the second direction.

Each deflector element may include a first portion oriented at the first acute angle, and an end portion that extends from the first portion, the end portion including a tip that extends substantially parallel to the target path. The end portion of each deflector element also may include a body including a surface, and the surface of the body forms a second acute angle with the target direction. The second acute angle may be equal to or less than the first acute angle.

In another general aspect, a deflector system for an extreme ultraviolet (EUV) light source includes a plurality of deflector elements, each deflector element including a first portion that extends along a first direction, and a second portion that extends from the first portion, the second portion including a body including one or more surfaces that extend from the first portion toward a tip. The deflector system is configured to be positioned in a vessel of the EUV light source such that the first direction and a target material path form a first acute angle, at least one of the surfaces of the body of the second portion and the target material path form a second acute angle, the target material path being a path along which targets travel in the vessel, the targets including target material that emits EUV light in a plasma state, and the second acute angle is greater than zero degrees.

Implementations may include one or more of the following features. The first acute angle may be zero degrees. A side surface of the first portion may be substantially aligned with a local gravity vector such that the side surface of the first portion of each deflector element has a vertical orientation when positioned in the vessel of the EUV light source. The second acute angle may be equal to or less than the first acute angle.

The plurality of deflector elements may be separated from each other such that an open channel is formed between any two deflector elements. The deflector elements may be parallel to each other.

Implementations of any of the techniques described above may include an EUV light source, a receptacle, a system, a method, a process, a device, or an apparatus. The details of one or more implementations are set forth in the accompanying drawings and the description below. Other features will be apparent from the description and drawings, and from the claims.

DRAWING DESCRIPTION

DETAILED DESCRIPTION

Figure 1A:
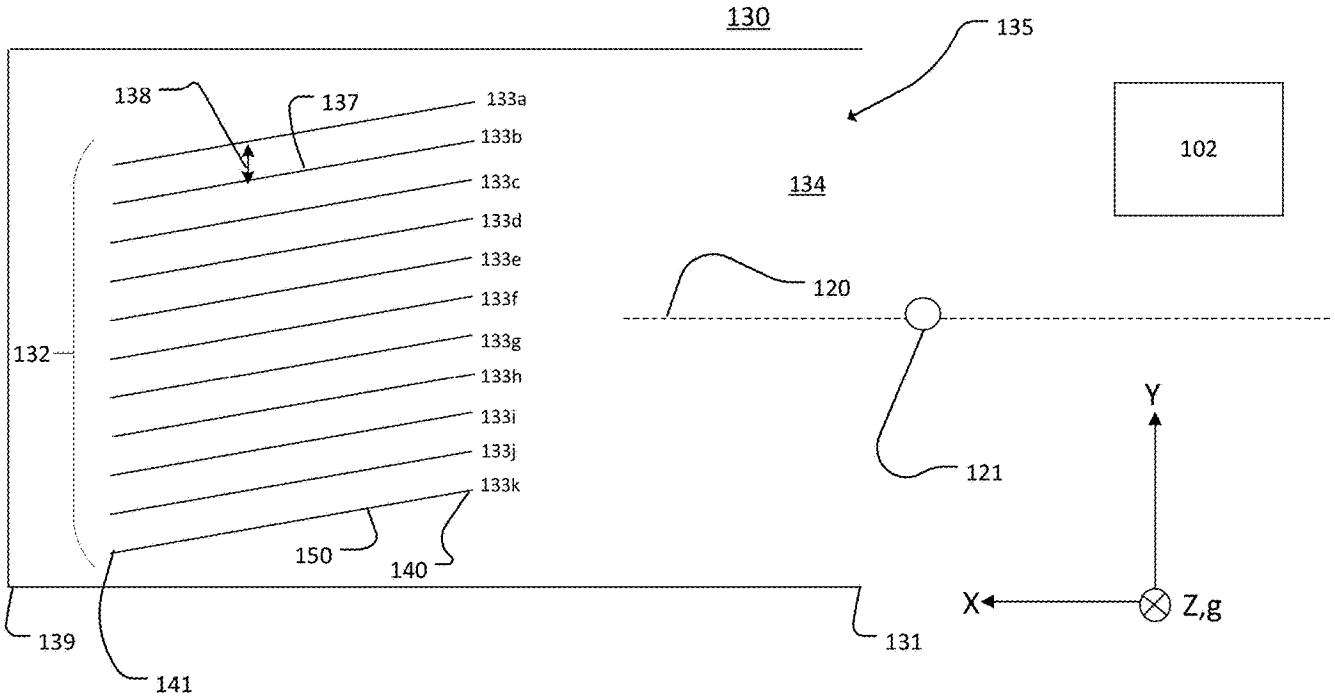
FIG. 1A is a block diagram of an example of a receptacle.

Referring to FIG. 1A, a block diagram of an example of an implementation of a receptacle 130 is shown. The receptacle 130 captures material 121 that travels along a material path 120. The material 121 may be any type of droplet or jet that includes at least some material in liquid phase. For example, the material 121 may be a droplet of molten tin or a droplet of target material that includes a molten metal and other substances, such as impurities, that may be in solid, liquid, or gaseous form. The material 121 interacts with one or more deflector elements 133 in a deflector system 132. The configuration of the deflector system 132 allows the receptacle 130 to capture more of the material 121 than would be possible without the deflector system 132. As discussed in greater detail below, the deflector system 132 decreases the amount of material that is scattered or splashed out of the receptacle 130 toward an object 102. Thus, the deflector system 132 may be used to reduce or eliminate contamination of the object 102 by, for example, fragments, portions, or droplets of the material 121.

The receptacle 130 includes a passageway 134 that extends along the X axis from a first receptacle end 131 to a second receptacle end 139. In the example of FIG. 1A, the material path 120 is also along the X axis, and the material 121 generally travels along the X direction. The passageway 134 has an opening 135 at the end 131, and the passageway 134 extends to toward the second receptacle end 139. The opening 135 is open to the exterior of the receptacle 130. The opening 135 coincides with the material path 120 such that the material 121 that travels on the material path 120 enters the passageway 134 through the opening 135. In the example of FIG. 1A, the second receptacle end 139 is enclosed such that there is no opening to the exterior of the receptacle 130 at the second receptacle end 139.

The receptacle 130 also includes the deflector system 132. The deflector system 132 includes deflector elements 133*a*-133*k* (collectively referred to as deflector elements 133). Each of the deflector elements 133 extends from a first deflector end 140 to a second deflector end 141. Each of the deflector elements 133 is oriented at an angle 136 relative to the direction in which the material 121 travels.

Figure 1B:
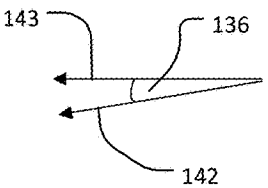
FIG. 1B is an example angle at which deflector elements of the receptacle of FIG. 1A may be oriented relative to a material path.

FIG. 1B shows the angle 136 for any of the deflector elements 133. The angle 136 is the angle formed by a direction 142, which is the direction in which the deflector element 133 extends from the first deflector end 140 to the second deflector end 141, and a direction 143, which is the direction in which material travels on the material path 120 at the deflector element 133. The angle 136 is an acute angle and may be any angle that is less than 90°. The angle 136 may be, for example, 7° or less, 12° or less, 15° or less. The value of the angle 136 may be the same for each of the deflector elements 133.

Additionally, the deflector elements 133 are separated from each other along the Y axis by a distance 138. In FIG. 1A, the distance 138 is shown between the deflector elements 133*a* and 133*b*. The distance 138 is large enough to prevent or minimize accumulation of the material 121 in the spaces between the deflector elements 133 but small enough such that instances of the material 121 that enter into open spaces or channels between the deflector elements 133 may bounce from the deflector elements 133 and in the channel multiple times. The distance 138 may be, for example, 5 millimeters (mm) or between 2 mm and 1 centimeter (cm).

In some implementations, any one of the deflector elements 133 is separated from the nearest other deflector element or deflector elements by the same separation distance.

The separation of the deflector elements 133 along the Y axis forms an open space or channel between any two adjacent deflector elements 133. An open space 137 is labeled between the deflector elements 133*a* and 133*b*. Open spaces or channels similar to the open space 137 exist between all of the other deflector elements 133. Each deflector element 133 also has side surfaces 150 that extend into the page. For example, and referring also to FIG. 1C, the deflector elements 133 may be formed from plates that extend in planes that are inclined at the angle 136 relative to the X-Z plane, and the plates may be parallel to each other.

The arrangement of the deflector elements 133 in the deflector system 132 reduces or eliminates splashing or scattering of the material 121, thereby reducing or eliminating the unexpected exit of the material 121 from the receptacle 130 through the opening 135. For example, orienting the deflector elements 133 at the angle 136 and spacing the deflector elements along the Y axis at the distance 138 to form the channels 137 helps to allow the receptacle 130 to capture the material 121.

Orienting an impact surface (a surface that interacts with the material 121) at a shallow angle (for example, 12° or less) relative to the material path 120 suppresses splashing or scattering of the material 121. Splashing or scattering may occur when the material 121 impacts a deflector element 133. If the material 121 is decelerated too quickly, a pressure wave may form in the material 121 and the pressure wave may overcome the surface tension of the material 121, resulting in the material 121 breaking into fragments. The deceleration of the material 121 is a function of the angle of the impact surface, and the deceleration may be reduced to a value at which little or no splashing or scattering of the material 121 occurs by reducing the angle 136. For a spherical droplet of the material 121, the absence or presence of splashing or scattering may be predicted by the Sommerfeld parameter ($K_n$) provided in Equation (1):

$$K_n = \sqrt[4]{\frac{\rho^3 D_0^3 V_n^5}{\sigma^2 \mu}}. \qquad \text{Equation (1)}$$

In Equation 1, $K_n$ is the Sommerfeld parameter, ρ is the density of the material 121, $D_o$ is the diameter of the material 121, $V_n$ is the velocity of the material 121 in a direction that is normal to the impact surface ($V_n=V_0 \sin \alpha$ where α is the angle 136), σ is the surface tension of the material 121, and μ is the viscosity of the material 121. Splashing or scattering is expected to occur if Kn>60 and to be suppressed if Kn<60. For Kn>60, the amount the amount of splashing decreases as the angle α decreases, and a lower value of $K_n$ indicates less splashing than a higher value of $K_n$. Because the value of $K_n$ depends on $V_n$, which in turn depends on the angle 136, the amount of splashing may be controlled using the angle 136.

In the deflector system 132, the angle 136 has a value that minimizes or eliminates splashing. Thus, the arrangement of the deflector elements 133 at the angle 136 relative to the material path 120 reduces or eliminates splashing or scattering of the material 121. Splashing from smooth surfaces is suppressed for $K_n$<60. A smooth surface is one that has a surface roughness that is much smaller than the diameter of the material 121. For example, the surface roughness of a smooth surface may be 10 times or 1000 times smaller than the diameter of the material 121. The surface roughness may be quantified by deviations of the direction of the normal vector of a real surface from its ideal (for example, perfectly smooth) form. The surface roughness may be expressed by the arithmetic average roughness, Ra, which has units of length. For an implementation in which the material 121 is a substantially spherical droplet with a diameter of 27 μm, the Ra surfaces of the deflector elements 133 may be, for example, 2.7 μm or 0.027 μm. For the material 121 being molten tin, Vo=70 m/s meters/second, Do=27 μm, ρ=6959 kilograms per cubic meter (kg/m$^3$), σ=0.535 Newtons per meter (N/m), and μ=1.58 e$^{-3}$ Pascal-second (Pa·s), $K_n$ is about 97 for α=19° and 18 for α=5°. Thus, decreasing the angle 136 from 19° to 5° reduces the amount of splashing of the material 121.

Moreover, using a relatively small angle for the angle 136 may reduce the occurrence and/or severity of crater-like structures or erosion on the deflector elements 133. The presence of a crater-like structure or other erosion on the deflector element 133 may result in a larger amount of the material 121 being scattered from the surface of the deflector element 133 as compared to a deflector element that lacks crater-like structures. For example, a dish-shaped crater tends to scatter material predominately in a backwards direction, which would be toward the opening 135 in the example shown in FIG. 1A. Thus, the presence of crater-like structures on the deflector elements 133 may increase scattering, and performance may be enhanced by reducing or eliminating the formation of crater-like structures on the deflector elements 133.

Using a relatively small value of the angle 136 may help to reduce the occurrence of crater-like structures on the deflector elements 133. The erosion rate of a solid surface that receives droplets depends on the momentum transfer between the droplet and the solid surface. The erosion rate (E) may be obtained from Equation 2:

$$E=k(Vn-Vc)^x \qquad \text{Equation (2).}$$

In Equation 2, k and x are constants that depend on the material 121, $V_n=V_0 \sin \alpha$ (where α is the angle 136), and Vc is the critical velocity for erosion to occur. Because the momentum transfer is a function of the impact angle (for example, the angle 136), momentum transfer may be reduced by reducing the angle 136.

Additionally, the use of two or more deflector elements 133 and the arrangement of the deflector elements 133 relative to each other at the distance 138 also reduces the probability that the material 121 will exit the receptacle 130 through the opening 135. One of the potential challenges of using a deflector system that includes a single deflector element oriented at a shallow angle relative to the direction of travel of the received material is that the surface of the deflector element extends toward the opening through which the material is received. Thus, there is a chance that the received material may interact with the surface, splash and then escape through the opening. The deflector system 132 addresses this challenge by using more than one deflector element 133 and spacing the deflector elements 133 at the distance 138 to form the channels 137. If the material 121 is scattered from the impact surface of a deflector element 133, the scattered material is likely to enter the channel 137. Once in the channel 137, the material 121 may scatter multiple times from the neighboring deflector elements 133, losing kinetic energy in the process. After losing kinetic energy, the material 121 is much less likely to escape through the opening 135. Thus, the arrangement of the deflector elements 133 reduces the amount of the material 121 that escapes from the receptacle 130 through the opening 135.

Moreover, in some implementations, the deflector elements 133 are arranged and/or designed to reduce adhesion of the material 121 to a surface of the deflector element 133. During use of the deflector system 132, it is possible that the material 121 may accumulate on the deflector elements 133. For example, all or part of a droplet of the material 121 may stay on a surface of the deflector element 133 instead of being scattered or splashed off. Bits or fragments of the material 121 that accumulate on the deflector elements 133 over time may form ball-like structures or other raised abnormalities on the surface of the deflector elements 133. These unintentional structures formed of the material 121 are collectively called accumulation structures, and an example of such a structure is labeled 163 in FIG. 1C. The orientation of the accumulation structures relative to the direction in which the material 121 travels is generally not controllable. Thus, the accumulation structures may scatter or splash the material 121 in any and/or all directions. As such, it may be desirable to reduce or eliminate the occurrence of accumulation structures on the deflector elements 133.

Figure 1C:
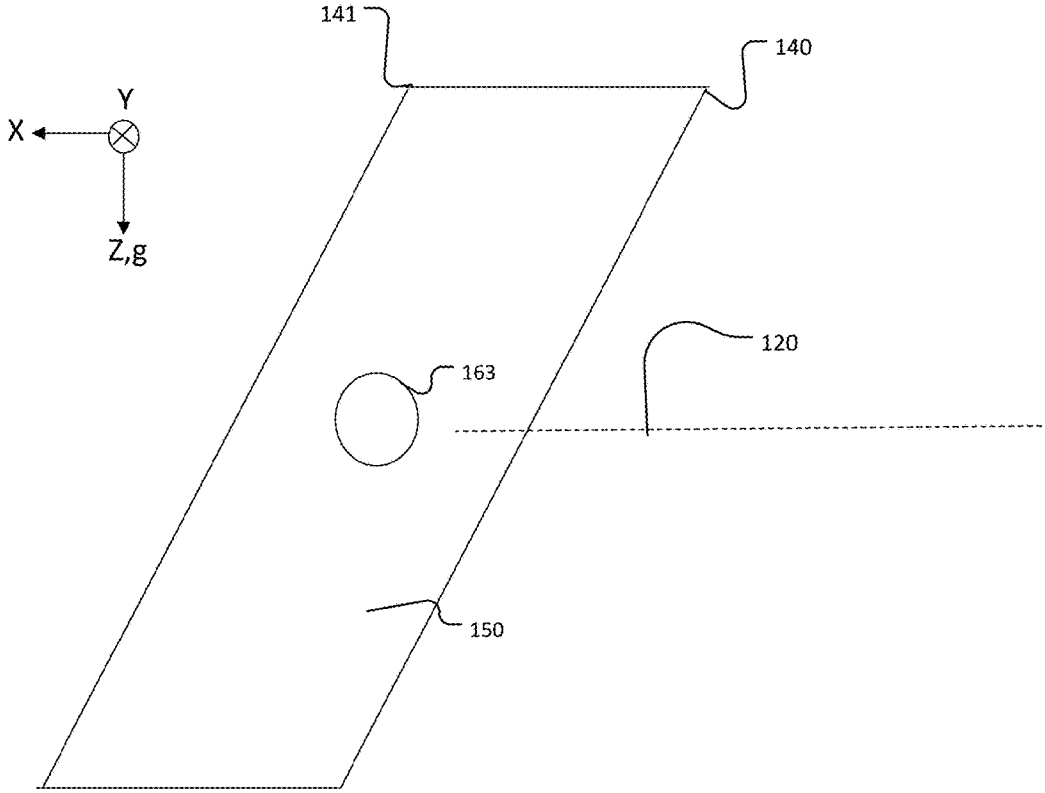
FIG. 1C is a side view of an example of a deflector element.
Figure 1D:
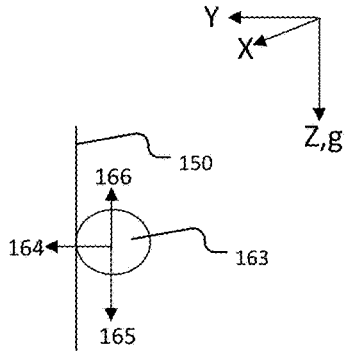
FIG. 1D illustrates an example orientation of a deflector element in operational use.

In some implementations (such as the implementation shown in FIGS. 1A-1C), at least a portion of the deflector element 133 is aligned with (for example, parallel to) a local gravity vector (shown as g) to reduce the amount of the material 121 that accumulates on the deflector element 133. In the example of FIG. 1C, the side surface 150 interacts with the material 121 and is aligned with (for example, parallel to) the local gravity vector such that the impact surface is vertical. The vertical orientation of the side surface 150 may aid in preventing accumulation structures from forming on the side surface 150. For illustration, an accumulation structure 163 is shown on the side surface 150. Referring also to FIG. 1D, the accumulation structure 163 experiences an adhesion force 164 in the Y direction, a gravitational force 165 in the Z direction (parallel to the local gravity vector g), and a friction force 166 in the −Z direction (opposite to the local gravity vector g). For an implementation in which the side surface 150 is vertical (such as shown in FIGS. 1A and 1C), only the friction force 166 is directed opposite to the gravitational force 165. The friction force 166 is typically much less than the gravitational force 165, thus, the net force in the Z direction is much less than the net force in the −Z direction. As a result, the vertical orientation of the side surface 150 may discourage the formation of accumulation structures at all and/or may prevent relatively large accumulation structures from forming.

As the side surface 150 becomes more horizontal (that is, closer to being parallel to an axis that is perpendicular to the local gravity vector g), the net force in the −Z direction increases such that it is more likely that accumulation structures form and/or grow larger. For example, for a surface oriented 19° relative to the Z direction and a molten tin material, the largest observed accumulation structure had a diameter of about 4.5 mm. In contrast, the largest observed accumulation structure for a surface oriented as shown in FIG. 1C was about 1.5 mm. It is believed that these observations indicate that the net upward force (the net force in the −Z direction) on an accumulation structure is about 27 times less in the case of the implementation shown in FIGS. 1A and 1C. Thus, the implementation shown in FIGS. 1A and 1C may help to reduce the occurrence and/or size of accumulation structures.

Alternatively or additionally, the deflector elements 133 may include surface features that reduce surface adhesion of the material 121. For example, the side surface 150 may include one or more surface features. The surface feature may include grooves, ripples, a region of a specific and pre-determined surface roughness, an oxidized surface, and/or a coating of a material that is different from the material used elsewhere on the surface. The surface feature may form a pattern, texture, or design on the surface with components (for example, grooves, lines, and/or channels) that are separated by a distance that is, for example, 10-50 times smaller than a diameter of the material that impacts the surface.

A surface pattern arranged in this manner at the impact surface of the deflector element 133 may help to enhance the repelling effect of the impact surface, making it less likely that the material 121 is able to accumulate on the surface of the deflector element 133. The spacing between individual components of the pattern depends on the size of the object to be repelled. As discussed above, it is desirable to repel larger structures (such as the accumulation structures) from the impact surfaces of the deflector elements 133. Thus, the separation between the components of the surface features may be determined by factors other than the size of an instance of the material 121. For example, in implementations in which an instance of the material 121 is substantially spherical and has a diameter of 27 μm. the separation between the components of the surface features may be between 2 μm and 20 μm.

Figure 2B:
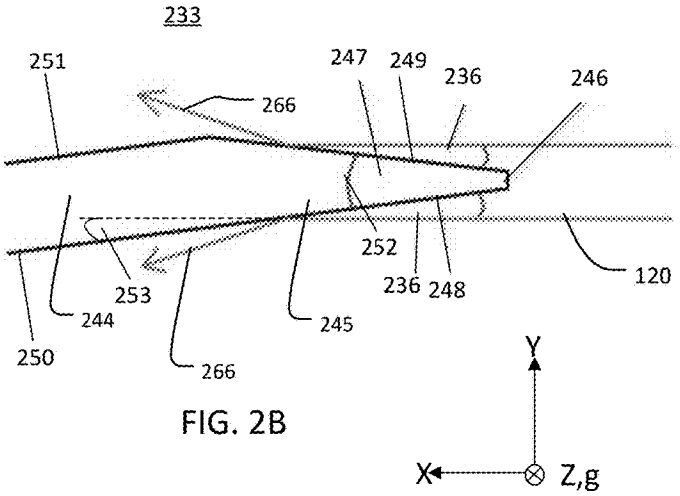
FIG. 2B is a top view of an example of a deflector element that may be used in the deflector system of FIG. 2A.
Figure 2A:
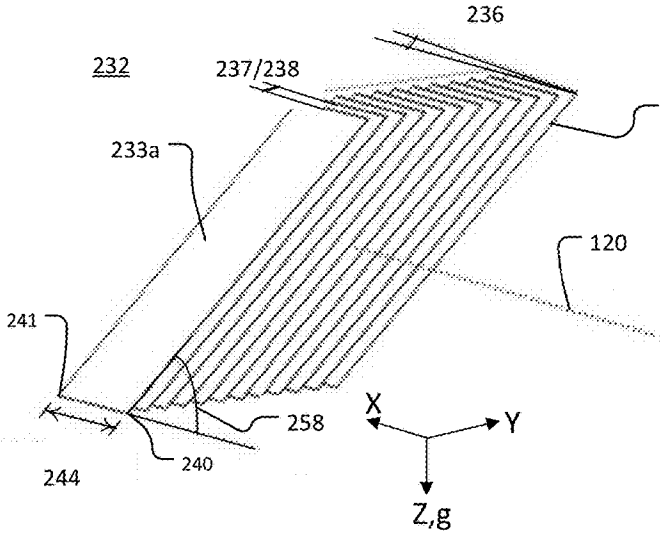
FIG. 2A is a perspective view of an example of a deflector system.
Figure 2C:
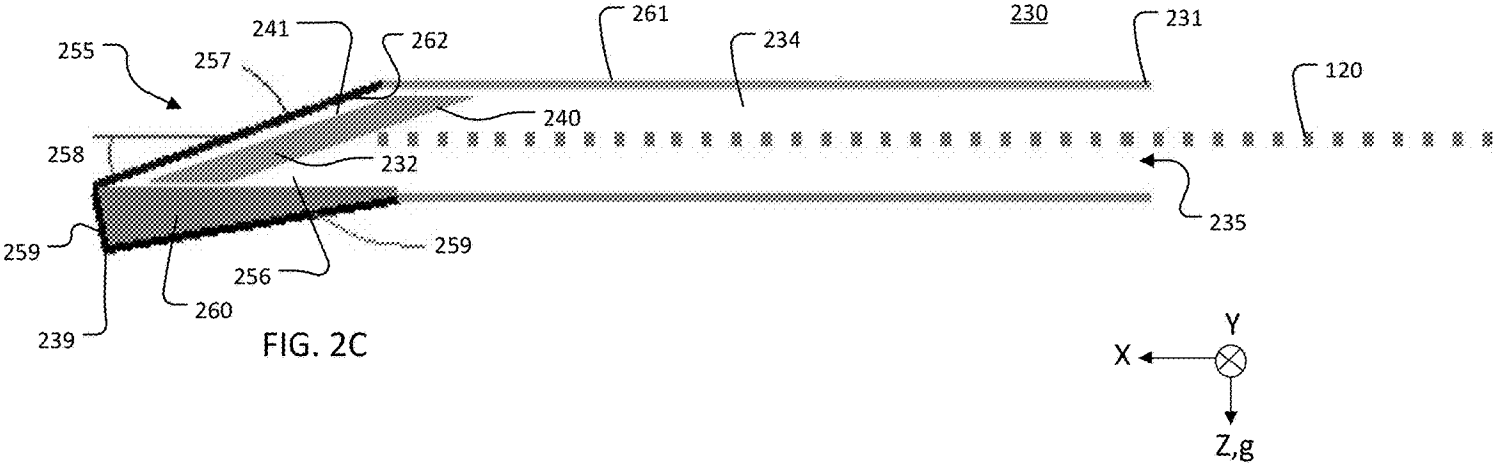
FIG. 2C is a block diagram of an example of a receptacle.

FIGS. 2A-2C show various views of a receptacle 230 and/or a deflector system 232. FIG. 2A is a perspective view of the deflector system 232. FIG. 2B is a top view of a single deflector element 233 of the deflector system 232. FIG. 2C is a side view of the receptacle 230. The receptacle 230 is an example of an implementation of the receptacle 130, and the deflector system 232 is an example of an implementation of the deflector system 132.

Referring to FIG. 2A, the deflector system 232 includes twelve deflector elements 233*a*-2331, collectively referred to as the deflector elements 233. For simplicity, only the deflector element 233*a* and the deflector element 2331 are labeled in FIG. 2A. Deflector elements 233*b*-233*k* are between the deflector element 233*a* and the deflector element 2331. Each deflector element 233 is separated from the nearest other deflector element along the Y axis by a distance 238. Each of the deflector elements 133 extends from a first deflector end 240 to a second deflector end 241. The deflector elements 233 may be made from any substance that is resistant to the material 121. For example, in implementations in which the material 121 is molten tin, the deflector elements 233 may be made from tungsten or any hard refractory metal or a ceramic.

Referring also to FIG. 2B, each of the deflector elements 233 includes a first portion 244 and a second portion 245. The second portion 245 extends from the first portion 244 to a tip 246. The second portion 245 and the first portion 244 are not labeled in FIG. 2A, but the tip 246 corresponds with the first deflector end 240, and the first portion 244 extends from the second portion 245 to the second deflector end 241. The second portion 245 has a body 247 that forms the exterior of the second portion 245 except for the tip 246. The body 247 has side surfaces 248 and 249 that extend from the first portion 244 and taper at an angle 252 to the tip 246. Thus, the tip 246 has a smaller extent (or width) along the Y axis than the first portion 244.

The first portion 244 is formed from a plate-like structure that has side surfaces 250 and 251. The deflector elements 233 are arranged such that the surface 250 of one deflector element 233 faces the surface 251 of another deflector element 233. Any two adjacent deflector elements 233 are separated along the Y axis by the distance 238 such that a channel 237 is formed between the surface 250 of one deflector element 233 and the surface 251 of the adjacent deflector element 233. The surfaces 250 and/or 251 are inclined relative to the material path 120 at an angle 253. In some implementations, the angle 253 and the angle 236 have different values, and the angle 236 may be less (smaller) than the angle 253.

A potential challenge with using multiple deflector elements 233 is that the first deflector end 240 of each deflector element 233 introduces a surface or leading edge that may cause splashing or scattering when the material 121 is received at the leading edge. In the example of FIG. 2B, the tip 246 may be considered to be a leading edge. One technique to address this potential challenge is to incline the tip 246 relative to the direction of travel of the material 121. Furthermore, reducing the extent of the tip 246 available to interact with the material 121 also may mitigate splashing. For example, if the extent of the tip 246 is less than the diameter of a droplet of the material 121, only a portion of the droplet impacts the tip 246 and the amount of the material 121 splashed is reduced. The second portion 245 is implemented to take advantage of either or both of these techniques to reduce splashing from the leading edge. For implementations in which the diameter of a droplet of the material 121 is, for example, 20-35 μm, the tip 246 may have an extent of 7 μm or less in at least one direction.

Thus, the extent of the tip 246 may be minimized in at least one direction to suppress splashing of the material 121. One of the potential challenges of using a deflector element that has a thin tip is that the tip may be fragile and/or prone to deformation. The deflector elements 233 address this challenge by being formed from sheets that are thick enough for mechanical robustness. The thickness of the sheets is such that the deflector elements 233 are not prone to warping when used with a molten metal and are resistant to breaking. For example, the deflector elements 233 may be 200 μm to 300 μm or 100 μm to 1 millimeter (mm) thick between the surfaces 250 and 251.

Additionally, the deflector elements 233 have a one-sided chamfer with an effective angle (the angle 252) that is as much as twice as large as the inclination of the surfaces 249 and 250. The inclination of the surfaces 248 and 249 is the angle 236. In the implementation shown in FIG. 2B, the angle 252 is twice as large as the angle 236. However, in some implementations, the angle 252 may be less than twice as large as the angle 236. In other words, the angle 252 may be an angle that is smaller (more acute) than an angle that is twice as large as the angle 236. Making the angle 252 twice as large as the angle 236 may result in a more mechanically robust deflector element 233, but a smaller angle 252 may result in improved performance and greater repelling of material.

A chamfer is a transitional edge between two faces of an object. The effective chamfer angle is the angle measured in a plane spanned by an incoming droplet of the material 121 and the deflection of that droplet assuming that the deflection is specular. Ray 266 in FIG. 2B shows the assumed specular deflection. In this configuration, the impact angle seen by incoming droplets of the material 121 (the angle 236) is the same on either side of the tip 246, and splashing and scattering is prevented or minimized. The actual chamfer angle of the second portion 245 is the angle measured in a plane perpendicular to the surface 248 (or the surface 249) and the tip 246. The actual chamfer angle is much larger than the effective chamfer angle due to the inclination of the tip 246, and the actual chamfer angle is sufficiently large to ensure mechanical robustness and manufacturability. For an implementation in which the angle 236 is 5° and the angle 252 is 10°, the actual chamfer angle is about 30°. As such, the deflector elements 233 have relatively thin leading edges or tips 246, yet the deflector elements 233 are structurally robust enough to be manufactured and used for prolonged periods of time.

FIG. 2C shows an example of the deflector system 232 being used in a receptacle 230. The receptacle 230 is a structure that defines a passageway 234 and includes a base portion 255. The passageway 234 extends along the X axis to a base interior 265, which is defined by the base portion 255. The receptacle 230 has an opening 235 at an end 231. The base portion 255 is located at an end 239. The opening 235 is coupled to the passageway 234. The opening 235 overlaps with the material path 120 such that material 121 traveling along the material path 120 passes through the opening 235 and into passageway 234. The base interior 256 is coupled to the passageway 234 such that material that enters the passageway 234 also may flow into the base interior 256.

The deflector system 232 is received in the base interior 256 such that all or at least some of the deflector elements 233 are in the base interior 256. The base portion 255 includes a base wall 257 that is angled at a base angle 258. The base angle 258 is the angle formed by a longitudinal axis of the passageway 234 (which is along the X axis in the example of FIG. 2C) and the base wall 257. The base portion 255 also includes side walls 259. Together, the base wall 257 and the side walls 259 form the base interior 256. The side walls 259 also define a reservoir region 260 in the base interior 256.

The base wall 257 extends at the base angle 258 from one of the side walls 259 to a wall 261 of the passageway 234. The base wall 257 has an interior base wall 262 that also extends at the base angle 258. The interior base wall 262 is made from a material that is resistant to corrosion by the material 121. For example, in implementations in which the material 121 is molten tin, the interior base wall 262 may be made from tungsten (W) or from another material that is coated with tungsten.

In operational use, the deflector system 232 is positioned in the base interior 256 with the deflector system 232 oriented at the angle 258 as shown in FIG. 2A. In the example of FIG. 2C, the local gravity vector (g) is along a direction that is parallel to the Z direction. Droplets or jets of the material 121 travel on the material path 120 and enter the receptacle 230 through the opening 235. In the example of FIGS. 2A-2C, the material path 120 is generally along the X direction, however gravity may pull the droplets or jets 121 slightly from the X direction.

The material 121 travels in the passageway 234 and into the base interior 256, where the material 121 interacts with the deflector system 232. As discussed above, the properties of the deflector system 232 suppress splashing and scattering of the material 121 and reduce the likelihood of the material 121 exiting through the opening 235. Moreover, the placement of the deflector system 232 in the base interior 256, relatively far from the opening 235, reduces the likelihood of portions of the material 121 exiting the receptacle 230 through the opening 235. Additionally, due to the orientation of the deflector system 232 at the base angle 258, fragments, pieces, or portions of the material 121 that are scattered by the deflector elements 233 may be directed into the reservoir region 260 instead being directed toward the opening 235.

The receptacle 230 is an example of a receptacle of a particular configuration in which the deflector system 232 may be used. However, the deflector system 232 may be used to retrofit receptacles of other designs. For example, the deflector system 232 may be used to retrofit a receptacle in which the base wall 257 perpendicular to the longitudinal axis of the passageway 234. In another example, the deflector system 232 may be used in a receptacle that does not include the passageway 234 such that the opening 235 is at the deflector system 232.

Figure 3:
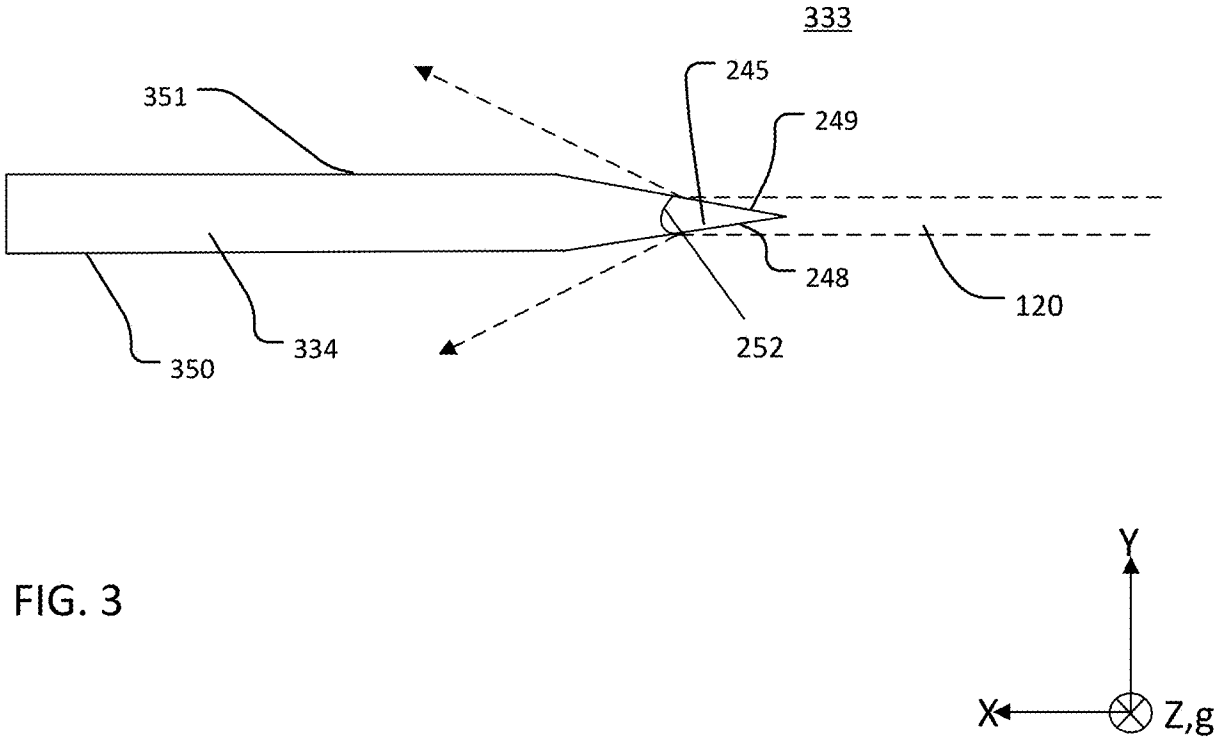
FIG. 3 is a top view of an another example of a deflector element.

Referring to FIG. 3, a top block diagram of a deflector element 333 is shown. The deflector element 333 may be used in the deflector system 132 or the deflector system 232. The deflector element 333 has a first portion 334 that extends along the X axis. The deflector element 333 also includes the second portion 245, which is discussed above with respect to FIGS. 2A and 2B. In the example shown in FIG. 3, the second portion 245 extends in the −X direction from the first portion 344. An angle similar to the angle 253 of FIG. 2B would be zero degrees for the deflector element 333. In operational use, the deflector element 333 may be positioned as shown in FIG. 3, with sides 350 and 351 of the first portion 334 and sides 248 and 249 of the second portion being planes that extend along the Z axis with the surfaces of the sides 248, 249, 350, and 351 being substantially parallel to a local gravity vector g.

The receptacles 130 and 230 may be used in any system in which suppression of scattering or splashing of a material that includes a liquid phase component is desired. For example, the receptacles 130 and 230 may be used in an ink jet printing system. In another example, the deflector systems 132 and 232 may be used in a system in which water is directed into a tube that is protected by a filter that prevents large particles from entering the tube. The water may splash from the filter before entering the tube. However, a deflector system such as the deflector systems 132 and 232, which has deflector elements inclined relative to the direction of propagation of the water jet, may be included with the filter or used with the filter to reduce the amount of water that is splashed away, thereby increasing the amount of water that is filtered. The techniques disclosed herein may be used in any application in which it is desirable to eliminate or reduce splashing from liquid droplets or jets that collide against a solid surface. Examples of such applications include industrial processes and/or applications, such as processes related to or employing inkjet printing, combustion, spray cooling, anti-icing, additive manufacturing, and/or surface coating.

Figure 4:
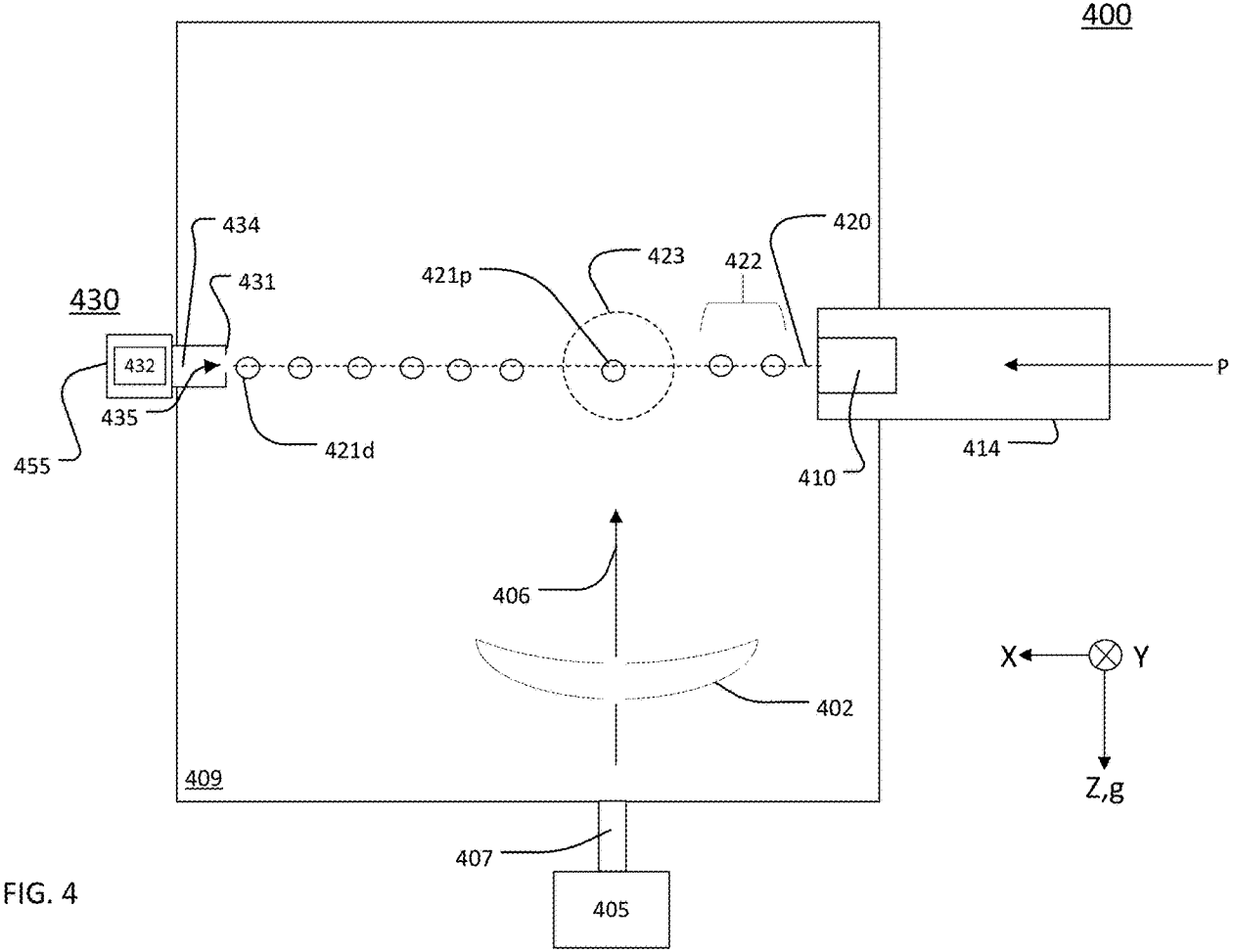
FIG. 4 is a block diagram of an example of an EUV light source.

In another example, the receptacle 130 or the receptacle 230 may be used in an extreme ultraviolet (EUV) light source. FIG. 4 is a block diagram of a receptacle 430 in an EUV light source 400. The receptacle 430 includes a deflector system 432. The deflector system 432 may be the deflector system 132 (FIG. 1A) or the deflector system 232 (FIGS. 2A-2C).

The EUV light source 400 includes a supply system 410 that emits a stream 422 of targets toward a plasma formation location 423 in a vacuum chamber 409. The targets in the stream 422 travel on a target path 420. The target path 420 is the spatial path along which an individual target in the stream 422 travels from the supply system 410 to the plasma formation location 423 (if the target is converted into plasma that emits EUV light) or to the receptacle 430 (if the target passes through the plasma formation location 423 without being converted to plasma that emits EUV light). The target material path 420 at any particular location is the direction in which an individual target is traveling at that location. In the example of FIG. 4, the target path 420 is illustrated as a straight dashed line that extends along the X axis. However, the target path 420 is not necessarily straight, and the target path 420 may be slightly different for each individual target in the stream 422. Moreover, the target path 420 may extend in a direction other than along the X axis. For example, the supply system 410 and the receptacle 430 may be arranged in a different configuration relative to each other than shown in FIG. 4, and thus the path between the supply system 410 and the receptacle 430 would be different than shown in FIG. 4.

In operational use, the supply system 410 is fluidly coupled to a reservoir 414 that contains target material under pressure P. The target material is any material that emits EUV light when in a plasma state. For example, the target material may include water, tin, lithium, and/or xenon. The target material may be in or may include a component that is in a molten or liquid state. The targets in the stream 422 may be considered to be droplets of target material or targets.

The stream 422 includes individual targets, including a target 421*p* that is in the plasma formation location 423. The plasma formation location 423 receives a light beam 406. The light beam 406 is generated by an optical source 405 and delivered to the vacuum chamber 409 via an optical path 407. An interaction between the light beam 406 and the target material in the target 421*p* produces a plasma that emits EUV light. The EUV light is collected by a mirror 402 and directed toward a lithography apparatus, such as the lithographic apparatus 500 shown in FIG. 5.

Some of the targets in the stream 422 are not converted to the plasma that emits EUV light. For example, a target may arrive in the plasma formation location 423 when the light beam 406 is not in the plasma formation location 423. Targets that are not converted to the plasma that emits EUV light pass through the plasma formation location 423 (such as a target 421*d*) and are captured by the receptacle 430.

The receptacle 430 includes a passage 434 and a base portion 455. In the example of FIG. 4, the deflector system 432 is in the base portion 455. The passage 434 includes an opening 435 at an end 431. The opening 435 coincides with the target path 420 such that targets flow through the opening 435 and into the passage 434. The passage 434 is coupled to an interior of the base portion 455 such that targets that flow in the passage interact with the deflector system 432 and, due to the configuration of the deflector system 432, are unlikely to splash or otherwise exit through the opening 435. In this way, the receptacle 430 captures unused targets and thereby helps to protect objects in the vacuum chamber 409 (such as the mirror 402) from becoming contaminated with material from splashed or scattered unused targets.

Figure 5:
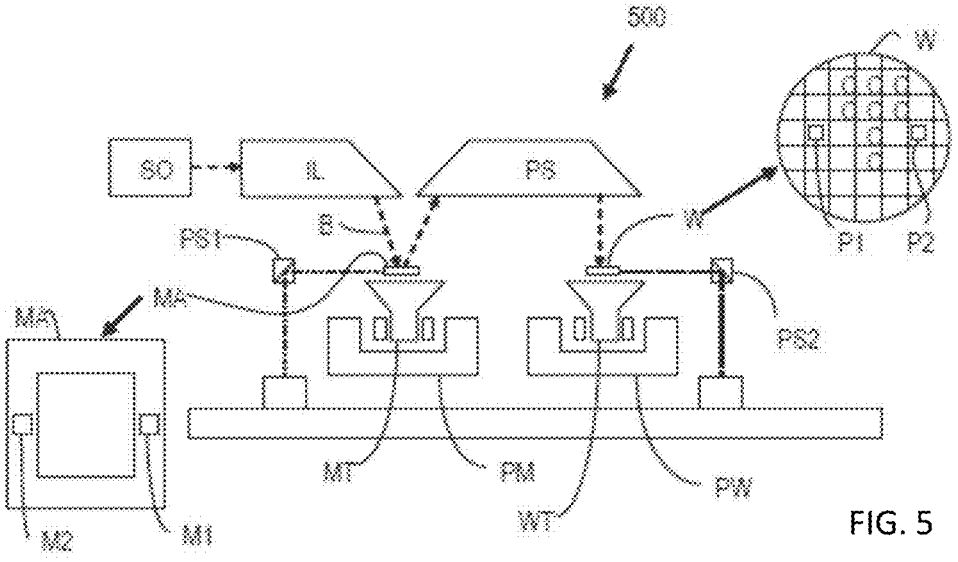
FIG. 5 is a block diagram of an example of a lithographic apparatus.

FIG. 5 schematically depicts a lithographic apparatus 500 including a source collector module SO according to one implementation. The receptacles 130, 230, and 430 are examples of receptacles that may be used as the trap 630 (FIG. 6) in the source collector module SO. The lithographic apparatus 500 includes:

- an illumination system (illuminator) IL configured to condition a radiation beam B (for example, EUV radiation).
- a support structure (for example, a mask table) MT constructed to support a patterning device (for example, a mask or a reticle) MA and connected to a first positioner PM configured to accurately position the patterning device;

a substrate table (for example, a wafer table) WT constructed to hold a substrate (for example, a resist-coated wafer) W and connected to a second positioner PW configured to accurately position the substrate; and a projection system (for example, a reflective projection system) PS configured to project a pattern imparted to the radiation beam B by patterning device MA onto a target portion C (for example, including one or more dies) of the substrate W.

The illumination system may include various types of optical components, such as refractive, reflective, magnetic, electromagnetic, electrostatic or other types of optical components, or any combination thereof, for directing, shaping, or controlling radiation.

The support structure MT holds the patterning device MA in a manner that depends on the orientation of the patterning device, the design of the lithographic apparatus, and other conditions, such as for example whether or not the patterning device is held in a vacuum environment. The support structure can use mechanical, vacuum, electrostatic or other clamping techniques to hold the patterning device. The support structure may be a frame or a table, for example, which may be fixed or movable as required. The support structure may ensure that the patterning device is at a desired position, for example with respect to the projection system.

The term "patterning device" should be broadly interpreted as referring to any device that can be used to impart a radiation beam with a pattern in its cross-section such as to create a pattern in a target portion of the substrate. The pattern imparted to the radiation beam may correspond to a particular functional layer in a device being created in the target portion, such as an integrated circuit.

The patterning device may be transmissive or reflective. Examples of patterning devices include masks, programmable mirror arrays, and programmable LCD panels. Masks are well known in lithography, and include mask types such as binary, alternating phase-shift, and attenuated phase-shift, as well as various hybrid mask types. An example of a programmable mirror array employs a matrix arrangement of small mirrors, each of which can be individually tilted so as to reflect an incoming radiation beam in different directions. The tilted mirrors impart a pattern in a radiation beam which is reflected by the mirror matrix.

The projection system PS, like the illumination system IL, may include various types of optical components, such as refractive, reflective, magnetic, electromagnetic, electrostatic or other types of optical components, or any combination thereof, as appropriate for the exposure radiation being used, or for other factors such as the use of a vacuum. It may be desired to use a vacuum for EUV radiation since other gases may absorb too much radiation. A vacuum environment may therefore be provided to the whole beam path with the aid of a vacuum wall and vacuum pumps.

As here depicted, the apparatus is of a reflective type (for example, employing a reflective mask).

The lithographic apparatus may be of a type having two (dual stage) or more substrate tables (and/or two or more patterning device tables). In such "multiple stage" machines the additional tables may be used in parallel, or preparatory steps may be carried out on one or more tables while one or more other tables are being used for exposure.

Referring to FIG. 5, the illuminator IL receives an extreme ultraviolet radiation beam from the source collector module SO. Methods to produce EUV light include, but are not necessarily limited to, converting a material into a plasma state that has at least one element, for example, xenon, lithium or tin, with one or more emission lines in the EUV range. In one such method, often termed laser produced plasma ("LPP") the required plasma can be produced by irradiating a fuel, such as a droplet, stream or cluster of material having the required line-emitting element, with a laser beam. The source collector module SO may be part of an EUV radiation system including a laser, not shown in FIG. 5, for providing the laser beam exciting the fuel. The resulting plasma emits output radiation, for example, EUV radiation, which is collected using a radiation collector, disposed in the source collector module. The laser and the source collector module may be separate entities, for example when a carbon dioxide ($CO_2$) laser is used to provide the laser beam for fuel excitation.

In such cases, the laser is not considered to form part of the lithographic apparatus and the radiation beam is passed from the laser to the source collector module with the aid of a beam delivery system including, for example, suitable directing mirrors and/or a beam expander. In other cases the source may be an integral part of the source collector module, for example when the source is a discharge produced plasma EUV generator, often termed as a DPP source.

The illuminator IL may comprise an adjuster for adjusting the angular intensity distribution of the radiation beam. Generally, at least the outer and/or inner radial extent (commonly referred to as σ-outer and σ-inner, respectively) of the intensity distribution in a pupil plane of the illuminator can be adjusted. In addition, the illuminator IL may comprise various other components, such as facetted field and pupil mirror devices. The illuminator IL may be used to condition the radiation beam, to have a desired uniformity and intensity distribution in its cross-section.

The radiation beam B is incident on the patterning device (for example, mask) MA, which is held on the support structure (for example, mask table) MT, and is patterned by the patterning device. After being reflected from the patterning device (for example, mask) MA, the radiation beam B passes through the projection system PS, which focuses the beam onto a target portion C of the substrate W. With the aid of the second positioner PW and position sensor PS2 (for example, an interferometric device, linear encoder or capacitive sensor), the substrate table WT can be moved accurately, for example, so as to position different target portions C in the path of the radiation beam B. Similarly, the first positioner PM and another position sensor PS1 can be used to accurately position the patterning device (for example mask) MA with respect to the path of the radiation beam B. Patterning device (for example mask) MA and substrate W may be aligned using patterning device alignment marks M1, M2 and substrate alignment marks P1, P2.

The depicted apparatus could be used in at least one of the following modes:

1. In step mode, the support structure (for example, mask table) MT and the substrate table WT are kept essentially stationary, while an entire pattern imparted to the radiation beam is projected onto a target portion C at one time (that is, a single static exposure). The substrate table WT is then shifted in the X and/or Y direction so that a different target portion C can be exposed.
2. In scan mode, the support structure (for example, mask table) MT and the substrate table WT are scanned synchronously while a pattern imparted to the radiation beam is projected onto a target portion C (that is, a single dynamic exposure). The velocity and direction of the substrate table WT relative to the support structure (for example, mask table) MT may be determined by the (de-)magnification and image reversal characteristics of the projection system PS.

3. In another mode, the support structure (for example, mask table) MT is kept essentially stationary holding a programmable patterning device, and the substrate table WT is moved or scanned while a pattern imparted to the radiation beam is projected onto a target portion C. In this mode, generally a pulsed radiation source is employed and the programmable patterning device is updated as required after each movement of the substrate table WT or in between successive radiation pulses during a scan. This mode of operation can be readily applied to maskless lithography that utilizes programmable patterning device, such as a programmable mirror array of a type as referred to above.

Combinations and/or variations on the above described modes of use or entirely different modes of use may also be employed.

Figure 6:
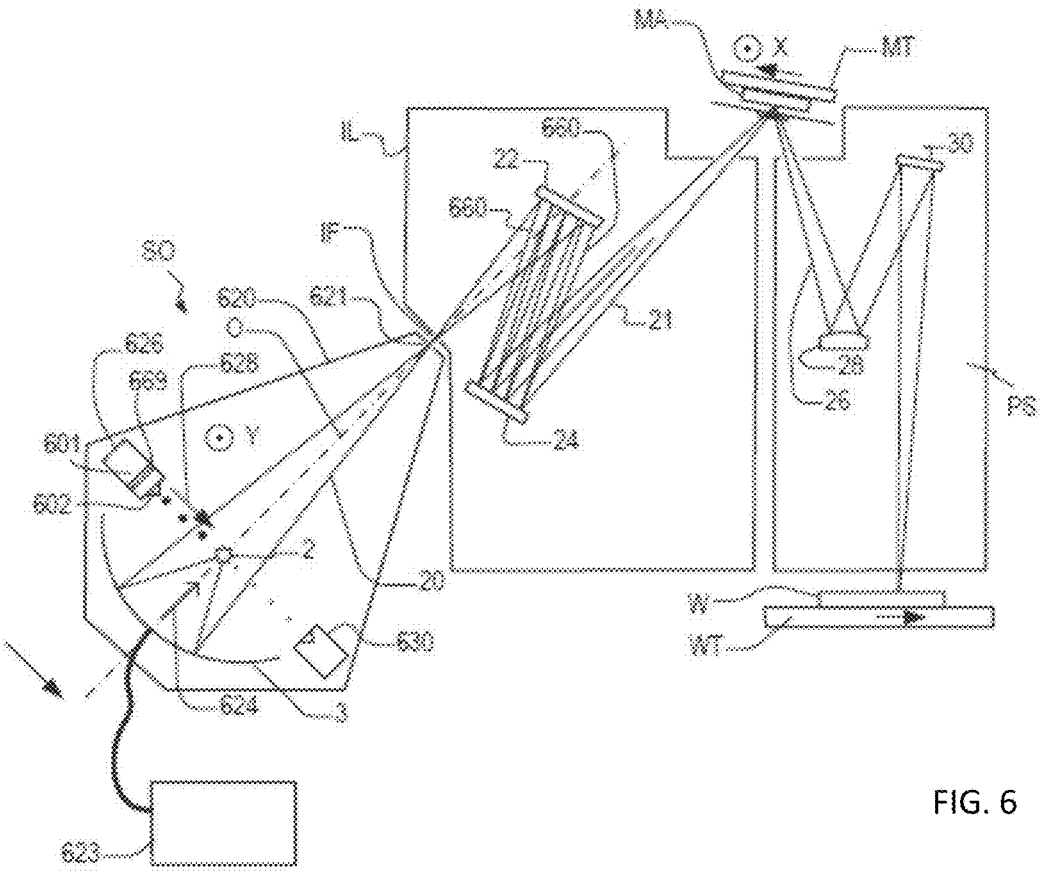
FIG. 6 is a more detailed view of the lithographic apparatus of FIG. 5.

FIG. 6 shows an implementation of the lithographic apparatus 500 in more detail, including the source collector module SO, the illumination system IL, and the projection system PS. The source collector module SO is constructed and arranged such that a vacuum environment can be maintained in an enclosing structure 620 of the source collector module SO. The systems IL and PS are likewise contained within vacuum environments of their own. An EUV radiation emitting plasma 2 may be formed by a laser produced LPP plasma source. The function of source collector module SO is to deliver EUV radiation beam 20 from the plasma 2 such that it is focused in a virtual source point. The virtual source point is commonly referred to as the intermediate focus (IF), and the source collector module is arranged such that the intermediate focus IF is located at or near an aperture 621 in the enclosing structure 620. The virtual source point IF is an image of the radiation emitting plasma 2.

From the aperture 621 at the intermediate focus IF, the radiation traverses the illumination system IL, which in this example includes a facetted field mirror device 22 and a facetted pupil mirror device 24. These devices form a so-called "fly's eye" illuminator, which is arranged to provide a desired angular distribution of the radiation beam 21, at the patterning device MA, as well as a desired uniformity of radiation intensity at the patterning device MA (as shown by reference 660). Upon reflection of the beam 21 at the patterning device MA, held by the support structure (mask table) MT, a patterned beam 26 is formed and the patterned beam 26 is imaged by the projection system PS via reflective elements 28, 30 onto a substrate W held by the substrate table WT. To expose a target portion C on substrate W, pulses of radiation are generated while substrate table WT and patterning device table MT perform synchronized movements to scan the pattern on patterning device MA through the slit of illumination.

Each system IL and PS is arranged within its own vacuum or near-vacuum environment, defined by enclosing structures similar to enclosing structure 620. More elements than shown may generally be present in illumination system IL and projection system PS. Further, there may be more mirrors present than those shown. For example there may be one to six additional reflective elements present in the illumination system IL and/or the projection system PS, besides those shown in FIG. 6.

Considering source collector module SO in more detail, a laser energy source including a laser 623 is arranged to deposit laser energy 624 into a fuel that includes a target material. The target material may be any material that emits EUV radiation in a plasma state, such as xenon (Xe), tin (Sn), or lithium (Li). The plasma 2 is a highly ionized plasma with electron temperatures of several 10's of electron volts (eV). Higher energy EUV radiation may be generated with other fuel materials, for example, terbium (Tb) and gadolinium (Gd). The energetic radiation generated during de-excitation and recombination of these ions is emitted from the plasma, collected by a near-normal incidence collector 3 and focused on the aperture 621. The plasma 2 and the aperture 621 are located at first and second focal points of collector CO, respectively.

Although the collector 3 shown in FIG. 6 is a single curved mirror, the collector may take other forms. For example, the collector may be a Schwarzschild collector having two radiation collecting surfaces. In an embodiment, the collector may be a grazing incidence collector which comprises a plurality of substantially cylindrical reflectors nested within one another.

To deliver the fuel, which, for example, is liquid tin, a droplet generator 626 is arranged within the enclosure 620, arranged to fire a high frequency stream 628 of droplets towards the desired location of plasma 2. In operation, laser energy 624 is delivered in a synchronism with the operation of droplet generator 626, to deliver impulses of radiation to turn each fuel droplet into a plasma 2. The frequency of delivery of droplets may be several kilohertz, for example 50 kHz. In practice, laser energy 624 is delivered in at least two pulses: a pre pulse with limited energy is delivered to the droplet before it reaches the plasma location, in order to vaporize the fuel material into a small cloud, and then a main pulse of laser energy 624 is delivered to the cloud at the desired location, to generate the plasma 2. A trap 630 (which may be, for example, the receptacle 130, the receptacle 230, or the receptacle 430) is provided on the opposite side of the enclosing structure 620, to capture fuel that is not, for whatever reason, turned into plasma.

The droplet generator 626 comprises a reservoir 601 which contains the fuel liquid (for example, molten tin) and a filter 669 and a nozzle 602. The nozzle 602 is configured to eject droplets of the fuel liquid towards the plasma 2 formation location. The droplets of fuel liquid may be ejected from the nozzle 602 by a combination of pressure within the reservoir 601 and a vibration applied to the nozzle by a piezoelectric actuator (not shown).

As the skilled reader will know, reference axes X, Y, and Z may be defined for measuring and describing the geometry and behavior of the apparatus, its various components, and the radiation beams 20, 21, 26. At each part of the apparatus, a local reference frame of X, Y and Z axes may be defined. In the example of FIG. 6, the Z axis broadly coincides with the direction optical axis O at a given point in the system, and is generally normal to the plane of a patterning device (reticle) MA and normal to the plane of substrate W. In the source collector module, the X axis coincides broadly with the direction of fuel stream 628, while the Y axis is orthogonal to that, pointing out of the page as indicated in FIG. 6. On the other hand, in the vicinity of the support structure MT that holds the reticle MA, the X axis is generally transverse to a scanning direction aligned with the Y axis. For convenience, in this area of the schematic diagram FIG. 6, the X axis points out of the page, again as marked. These designations are conventional in the art and will be adopted herein for convenience. In principle, any reference frame can be chosen to describe the apparatus and its behavior.

Numerous additional components used in the operation of the source collector module and the lithographic apparatus 500 as a whole are present in a typical apparatus, though not illustrated here. These include arrangements for reducing or mitigating the effects of contamination within the enclosed vacuum, for example to prevent deposits of fuel material damaging or impairing the performance of collector 3 and other optics. Other features present but not described in detail are all the sensors, controllers and actuators involved in controlling of the various components and sub-systems of the lithographic apparatus 500.

Figure 7:
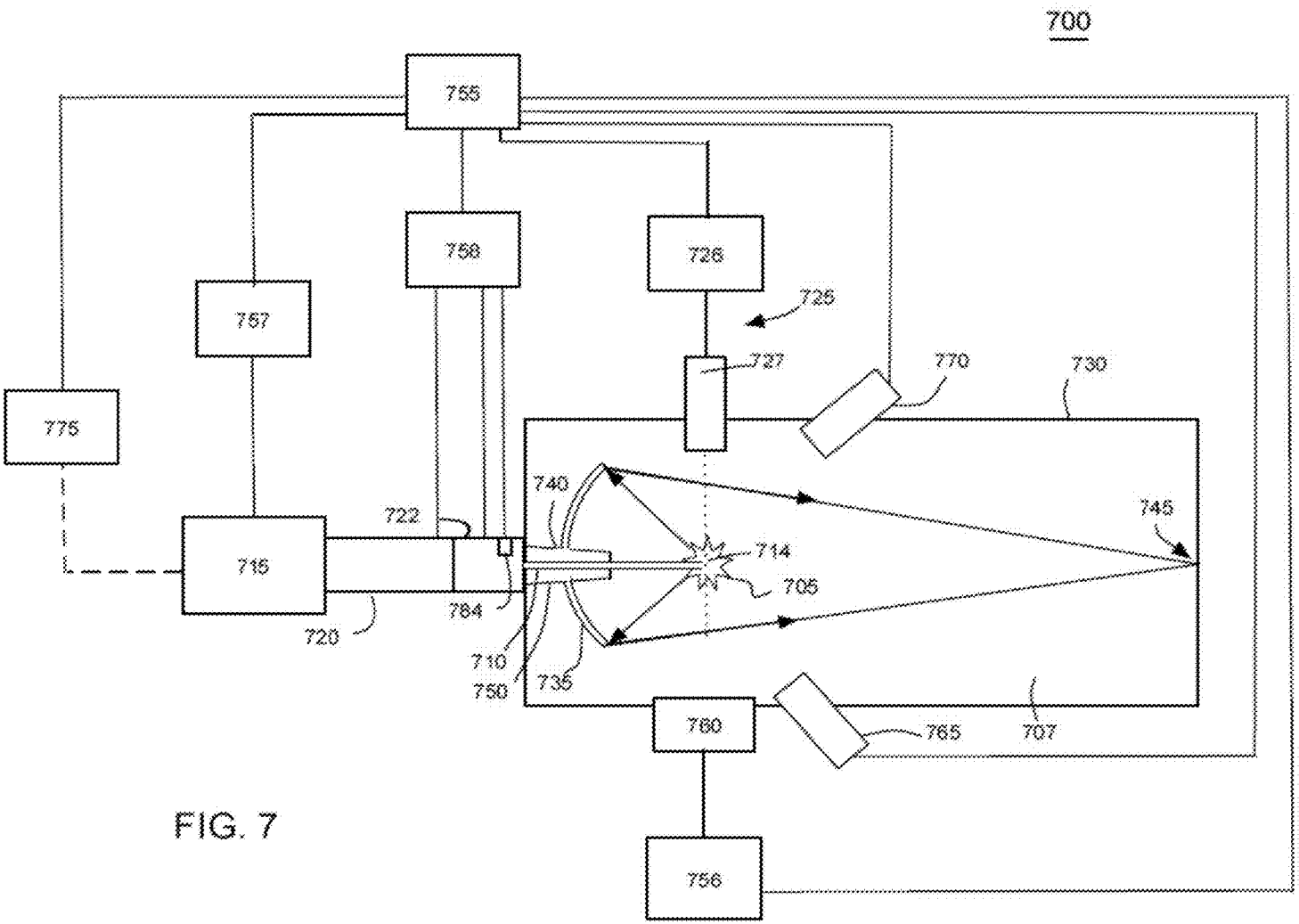
FIG. 7 is a block diagram of another example of an EUV light source.

Referring to FIG. 7, an implementation of an LPP EUV light source 700 is shown. The light source 700 may be used as the source collector module SO in the lithographic apparatus 500. Moreover, any of the receptacles 130, 230, and 430 may be used with the light source 700. Furthermore, the optical source 405 of FIG. 4 may be part of the drive laser 715. The drive laser 715 may be used as the laser 623 (FIG. 6).

The LPP EUV light source 700 is formed by irradiating a target mixture 714 at a plasma formation location 705 with an amplified light beam 710 that travels along a beam path toward the target mixture 714. The material 121 discussed with respect to FIGS. 1, 2A-2C, and 3, and the targets in the stream 422 discussed with respect to FIG. 4 may be or include the target mixture 714. The plasma formation location 705 is within an interior 707 of a vacuum chamber 730. When the amplified light beam 710 strikes the target mixture 714, a target material within the target mixture 714 is converted into a plasma state that has an element with an emission line in the EUV range. The created plasma has certain characteristics that depend on the composition of the target material within the target mixture 714. These characteristics may include the wavelength of the EUV light produced by the plasma and the type and amount of debris released from the plasma.

The light source 700 also includes the supply system 725 that delivers, controls, and directs the target mixture 714 in the form of liquid droplets, a liquid stream, solid particles or clusters, solid particles contained within liquid droplets or solid particles contained within a liquid stream. The target mixture 714 includes the target material such as, for example, water, tin, lithium, xenon, or any material that, when converted to a plasma state, has an emission line in the EUV range. For example, the element tin may be used as pure tin (Sn); as a tin compound, for example, $SnBr_4$, $SnBr_2$, $SnH_4$; as a tin alloy, for example, tin-gallium alloys, tin-indium alloys, tin-indium-gallium alloys, or any combination of these alloys. The target mixture 714 may also include impurities such as non-target particles. Thus, in the situation in which there are no impurities, the target mixture 714 is made up of only the target material. The target mixture 714 is delivered by the supply system 725 into the interior 707 of the chamber 730 and to the plasma formation location 705.

The light source 700 includes a drive laser system 715 that produces the amplified light beam 710 due to a population inversion within the gain medium or mediums of the laser system 715. The light source 700 includes a beam delivery system between the laser system 715 and the plasma formation location 705, the beam delivery system including a beam transport system 720 and a focus assembly 722. The beam transport system 720 receives the amplified light beam 710 from the laser system 715, and steers and modifies the amplified light beam 710 as needed and outputs the amplified light beam 710 to the focus assembly 722. The focus assembly 722 receives the amplified light beam 710 and focuses the beam 710 to the plasma formation location 705.

In some implementations, the laser system 715 may include one or more optical amplifiers, lasers, and/or lamps for providing one or more main pulses and, in some cases, one or more pre-pulses. Each optical amplifier includes a gain medium capable of optically amplifying the desired wavelength at a high gain, an excitation source, and internal optics. The optical amplifier may or may not have laser mirrors or other feedback devices that form a laser cavity. Thus, the laser system 715 produces an amplified light beam 710 due to the population inversion in the gain media of the laser amplifiers even if there is no laser cavity. Moreover, the laser system 715 may produce an amplified light beam 710 that is a coherent laser beam if there is a laser cavity to provide enough feedback to the laser system 715. The term "amplified light beam" encompasses one or more of: light from the laser system 715 that is merely amplified but not necessarily a coherent laser oscillation and light from the laser system 715 that is amplified and is also a coherent laser oscillation.

The optical amplifiers in the laser system 715 may include as a gain medium a filling gas that includes $CO_2$ and may amplify light at a wavelength of between about 9100 and about 11000 nm, and in particular, at about 10600 nm, at a gain greater than or equal to 800 times. Suitable amplifiers and lasers for use in the laser system 715 may include a pulsed laser device, for example, a pulsed, gas-discharge $CO_2$ laser device producing radiation at about 9300 nm or about 10600 nm, for example, with DC or RF excitation, operating at relatively high power, for example, 10 kW or higher and high pulse repetition rate, for example, 40 kHz or more. The pulse repetition rate may be, for example, 50 kHz. The optical amplifiers in the laser system 715 may also include a cooling system such as water that may be used when operating the laser system 715 at higher powers.

The light source 700 includes a collector mirror 735 having an aperture 740 to allow the amplified light beam 710 to pass through and reach the plasma formation location 705. The collector mirror 735 may be, for example, an ellipsoidal mirror that has a primary focus at the plasma formation location 705 and a secondary focus at an intermediate location 745 (also called an intermediate focus) where the EUV light may be output from the light source 700 and may be input to, for example, an integrated circuit lithography tool (not shown). The light source 700 may also include an open-ended, hollow conical shroud 750 (for example, a gas cone) that tapers toward the plasma formation location 705 from the collector mirror 735 to reduce the amount of plasma-generated debris that enters the focus assembly 722 and/or the beam transport system 720 while allowing the amplified light beam 710 to reach the plasma formation location 705. For this purpose, a gas flow may be provided in the shroud that is directed toward the plasma formation location 705.

The light source 700 may also include a master controller 755 that is connected to a droplet position detection feedback system 756, a laser control system 757, and a beam control system 758. The light source 700 may include one or more target or droplet imagers 760 that provide an output indicative of the position of a droplet, for example, relative to the plasma formation location 705 and provide this output to the droplet position detection feedback system 756, which may, for example, compute a droplet position and trajectory from which a droplet position error may be computed either on a droplet by droplet basis or on average. The droplet position detection feedback system 756 thus provides the droplet position error as an input to the master controller 755. The master controller 755 may therefore provide a laser position, direction, and timing correction signal, for example, to the laser control system 757 that may be used, for example, to control the laser timing circuit and/or to the beam control system 758 to control an amplified light beam position and shaping of the beam transport system 720 to change the location and/or focal power of the beam focal spot within the chamber 730.

The supply system 725 includes a target material delivery control system 726 that is operable, in response to a signal from the master controller 755, for example, to modify the release point of the droplets as released by a target material supply apparatus 727 to correct for errors in the droplets arriving at the desired plasma formation location 705.

Additionally, the light source 700 may include light source detectors 765 and 770 that measures one or more EUV light parameters, including but not limited to, pulse energy, energy distribution as a function of wavelength, energy within a particular band of wavelengths, energy outside of a particular band of wavelengths, and angular distribution of EUV intensity and/or average power. The light source detector 765 generates a feedback signal for use by the master controller 755. The feedback signal may be, for example, indicative of the errors in parameters such as the timing and focus of the laser pulses to properly intercept the droplets in the right place and time for effective and efficient EUV light production.

The light source 700 may also include a guide laser 775 that may be used to align various sections of the light source 700 or to assist in steering the amplified light beam 710 to the plasma formation location 705. In connection with the guide laser 775, the light source 700 includes a metrology system 724 that is placed within the focus assembly 722 to sample a portion of light from the guide laser 775 and the amplified light beam 710. In other implementations, the metrology system 724 is placed within the beam transport system 720. The metrology system 724 may include an optical element that samples or re-directs a subset of the light, such optical element being made out of any material that may withstand the powers of the guide laser beam and the amplified light beam 710. A beam analysis system is formed from the metrology system 724 and the master controller 755 since the master controller 755 analyzes the sampled light from the guide laser 775 and uses this information to adjust components within the focus assembly 722 through the beam control system 758.

Thus, in summary, the light source 700 produces an amplified light beam 710 that is directed along the beam path to irradiate the target mixture 714 at the plasma formation location 705 to convert the target material within the mixture 714 into plasma that emits light in the EUV range. The amplified light beam 710 operates at a particular wavelength (that is also referred to as a drive laser wavelength) that is determined based on the design and properties of the laser system 715. Additionally, the amplified light beam 710 may be a laser beam when the target material provides enough feedback back into the laser system 715 to produce coherent laser light or if the drive laser system 715 includes suitable optical feedback to form a laser cavity.

Other implementations are within the scope of the claims. For example, the deflection system 132 and the deflection system 232 may be held in the respective receptacles 130 and 230 by any support known in the art.

In another example, FIGS. 1A and 1B show the angle 136 as being an acute angle that is greater than zero. However, in some implementations, such as shown in FIG. 3, the angle 136 may be zero such that the deflector elements 133 are substantially parallel to the material path 120. Such an implementation may provide enhanced performance compared to, for example, a honeycomb type structure that is aligned substantially parallel to a material path. For example, the deflector elements 133 may be planar structures that are open at both ends in the Y-Z plane but still form open channels due to the deflector elements 133 being separated from each other by the distance 138. Such an arrangement results in relatively fewer surfaces for material accumulation compared to a tube-like or honeycomb structure and may result in less splashing of the material 121.

What is claimed is:

1. A target material receptacle comprising:

a structure comprising a first end, a second end, and a sidewall that extends in a first direction from an opening at the first end to the second end to define a passageway, the passageway configured to receive target material that travels along a target material path; and a deflector system configured to receive target material from the passageway, the deflector system comprising a plurality of deflector elements extending from the second end toward the opening, wherein each deflector element is oriented at a first acute angle relative to a direction of travel of an instance of the target material that travels along the target material path, and each deflector element in the deflector system is separated from a nearest deflector element by a distance along a second direction that is different from the first direction.

2. The target material receptacle of claim 1, wherein the structure further comprises a base portion at the second end, the base portion comprising an interior that is coupled to the passageway.

3. The target material receptacle of claim 2, wherein at least a portion of the deflector system is positioned in the interior of the base portion, a side of the base portion is angled at a base angle relative to the first direction, and the side of the base portion extends in the second direction.

4. The target material receptacle of claim 1, wherein each deflector element comprises a first portion oriented at the first acute angle relative to the target material path, and an end portion that extends from the first portion, the end portion comprising a tip that extends substantially parallel to the target material path.

5. The target material receptacle of claim 4, wherein the end portion of each deflector element further comprises a body comprising a surface, and the surface of the body forms a second acute angle with the target material path.

6. The target material receptacle of claim 5, wherein the second acute angle is equal to or less than the first acute angle.

7. The target material receptacle of claim 4, wherein the first portion of each deflector element comprises a plate that extends in a first plane, the plate having a first extent in the first plane and a second extent in a second plane, the second plane being orthogonal to the first plane and the second extent being less than the first extent.

8. The target material receptacle of claim 4, wherein the instance of target material is substantially spherical and has a diameter, each tip has a surface configured to interact with the instance of target material, the surface of the tip having an extent in at least one direction that is less than the diameter of the instance of target material.

9. The target material receptacle of claim 1, wherein each deflector element comprises at least one surface feature configured to reduce adhesion of target material to a surface of the deflector element, the surface feature comprising ripples, a region having a specific roughness, an oxidized region, a pattern of grooves, and/or a coating of a material that is different from material used in other portions of the surface of the deflector element.

10. The target material receptacle of claim 1, wherein the distance along the second direction between any two adjacent deflector elements is the same.

11. The target material receptacle of claim 1, wherein the first acute angle is the same for all of the deflector elements.

12. The target material receptacle of claim 1, wherein each deflector element is a plate, and the deflector elements are separated along the second direction such that any one of the plates is parallel with all of the other plates.

13. The target material receptacle of claim 1, wherein the target material receptacle is configured for use in an extreme ultraviolet (EUV) light source, and the target material comprises a material that emits EUV light when in a plasma state.

14. An extreme ultraviolet (EUV) light source comprising:

an optical source configured to produce an optical beam;

a vessel configured to receive the optical beam at a plasma formation location;

a supply system configured to produce targets that travel along a target path toward the plasma formation location; and a target material receptacle comprising:

a structure comprising a first end, a second end, and a sidewall that extends in a first direction from an opening at the first end to the second end to define a passageway, the passageway positioned to receive targets that travel on the target path and pass through the plasma formation location; and a deflector system configured to receive targets from the passageway, the deflector system comprising a plurality of deflector elements extending from the second end toward the opening, wherein each deflector element is oriented at a first acute angle relative to a direction of travel of an instance of the material that travels along the target material path, and each deflector element in the deflector system is separated from a nearest deflector element by a distance along a second direction that is different from the first direction.

15. The EUV light source of claim 14, wherein the structure further comprises a base portion at the second end, the base portion comprising an interior that is coupled to the passageway.

16. The EUV light source of claim 15, wherein at least a portion of the deflector system is positioned in the interior of the base portion, a side of the base portion is angled at a base angle relative to the first direction, and the side of the base portion extends in the second direction.

17. The EUV light source of claim 14, wherein each deflector element comprises a first portion oriented at the first acute angle, and an end portion that extends from the first portion, the end portion comprising a tip that extends substantially parallel to the target path.

18. The EUV light source of claim 17, wherein the end portion of each deflector element further comprises a body comprising a surface, and the surface of the body forms a second acute angle with the target direction.

19. The EUV light source of claim 18, wherein the second acute angle is equal to or less than the first acute angle.

20. A deflector system for an extreme ultraviolet (EUV) light source, the deflector system comprising:

a plurality of deflector elements, each deflector element comprising a first portion that extends along a first direction, and a second portion that extends from the first portion, the second portion comprising a body comprising one or more surfaces that extend from the first portion toward a tip wherein, the deflector system is configured to be positioned in a vessel of the EUV light source such that the first direction and a target material path form a first acute angle, at least one of the surfaces of the body of the second portion and the target material path form a second acute angle, the target material path is a path along which targets emitted from a target material supply apparatus travel in the vessel, the targets comprise target material that emits EUV light in a plasma state, the second acute angle is greater than zero degrees, the vessel comprises a structure, the structure comprising a first end, a second end, and a sidewall that extends from an opening at the first end to the second end to define a passageway, the passageway positioned to receive targets that travel on the target path and pass through the plasma formation location, and, when the deflector system is positioned in the vessel for operational use, the first portion of the deflector elements extend from the second end of the structure toward the opening.

21. The deflector system of claim 20, wherein the first acute angle is zero degrees.

22. The deflector system of claim 21, wherein a side surface of the first portion is substantially aligned with a local gravity vector such that the side surface of the first portion of each deflector element has a vertical orientation when positioned in the vessel of the EUV light source.

23. The deflector system of claim 20, wherein the second acute angle is equal to or less than the first acute angle.

24. The deflector system of claim 20, wherein the plurality of deflector elements are separated from each other such that an open channel is formed between any two deflector elements.

25. The deflector system of claim 24, wherein the deflector elements are parallel to each other.

26. The target material receptacle of claim 1, wherein, in use, the opening of the structure faces a target material supply apparatus configured to emit the instance of the target material, and the target material path extends from the target material supply apparatus into the opening.

27. The target material receptacle of claim 1, wherein the target material path is parallel with the first direction at the deflector system.

28. The EUV light source of claim 14, wherein the target path extends from the supply system, through the plasma formation location, and into the opening, and the opening faces the supply system.

29. A target material receptacle comprising:

a structure comprising a first end, a second end, an opening at the first end, and a passageway that extends in one plane along a first direction from opening to the second end; and a deflector system in the structure at the second end, the deflector system comprising a plurality of plate deflector elements in the passageway and extending from the second end toward the first end, wherein each plate deflector element has a first extent in a first plane and a second extent in a second plane, the second plane being orthogonal to the first plane and the second extent being less than the first extent, and each plate deflector element is oriented relative to the first direction such that the first plane forms an acute angle with the first direction.

30. The target material receptacle of claim 29, wherein each plate deflector element comprises a first portion and a second portion that extends from the first portion, the first portion comprising the first extent and the second extent, and the second portion comprising a body comprising one or more surfaces that extend from the first portion toward a tip, at least one of the one or more surfaces forming an acute angle with the first direction.

* * * * *